US005215214A

United States Patent [19]

Lev et al.

[11] Patent Number: 5,215,214

[45] Date of Patent: Jun. 1, 1993

[54] MULTI-COMPARTMENT LIQUID STORAGE CONTAINER

[76] Inventors: Shlomo Lev, 25 Aronowitz St., Holon; Baruch Kogan, 14 Sheftel St., Rishon LeZion, both of Israel

[21] Appl. No.: 756,037

[22] Filed: Sep. 6, 1991

[51] Int. Cl.[5] ..... G01F 11/00

[52] U.S. Cl. ..... 222/1; 220/502; 222/83; 222/132; 222/145; 222/541

[58] Field of Search ..... 222/1, 80, 81, 82, 83, 222/129, 132, 145, 481, 482, 541; 220/501, 502, 506, 553, 555

[56] References Cited

U.S. PATENT DOCUMENTS

| | | | |
|---|---|---|---|
| 3,379,338 | 4/1968 | Marks et al. | 220/501 X |
| 3,603,485 | 9/1971 | Vivier | 222/129 |
| 3,851,800 | 12/1974 | Swain | 222/145 |
| 4,410,085 | 10/1983 | Beneziat et al. | 220/506 X |
| 4,537,326 | 8/1985 | Morehead | 222/541 X |
| 4,687,663 | 8/1987 | Schaeffer | 222/1 X |
| 4,801,008 | 1/1989 | Rich | 222/145 X |
| 4,811,549 | 3/1989 | Usami et al. | 222/145 X |
| 4,830,273 | 5/1989 | Kalberer et al. | 222/541 X |
| 4,961,516 | 10/1990 | Nakamura | 222/145 X |
| 4,984,715 | 1/1991 | Green | 222/129 |

FOREIGN PATENT DOCUMENTS

| | | | |
|---|---|---|---|
| 2241225 | 8/1991 | United Kingdom | 222/541 |

*Primary Examiner*—Andres Kashnikow

*Assistant Examiner*—Joseph A. Kaufman

*Attorney, Agent, or Firm*—Edward Langer

[57] ABSTRACT

A multi-compartment liquid storage container capable of separately storing two or more liquids which may become mixed upon pouring. The storage container comprises a primary container with an internal container of smaller diameter within the hollow of the primary container thus creating an additional storage compartment. Removal of the pull-tab provided on the primary container enables access to the contents of the primary container and the additional storage compartment. In an alternative embodiment, the primary container is provided with a non-removable lift-tab opening and a penetrable foil section is provided in the wall of the internal container. The lift-tab perforates the foil during the opening procedure to provide internal container access. Another alternative embodiment provides an internal container sub-divided by additional compartments, each sealed off from the other by a penetrable foil membrane, allowing for separate storage of a plurality of liquids simultaneously. A removable pull-tab or non-removable lift-tab opening may be provided in this arrangement, and a straw may be used to perforate the membrane between the sections, allowing access to the various liquids. In yet another alternative embodiment, the container has a plurality of access openings, each allowing access to a separate storage compartment, and when opened together, the liquids may be simultaneously poured and mixed.

6 Claims, 5 Drawing Sheets

MULTI-COMPARTMENT LIQUID STORAGE CONTAINER

FIELD OF THE INVENTION

The present invention relates to liquid storage containers, and more particularly to a liquid storage container having multiple compartments for storing a plurality of different liquids intended for mixing upon pouring.

BACKGROUND OF THE INVENTION

There are known various types of containers for the storage of liquids comprising a single substance. Such containers are generally produced from aluminum, plastic or glass materials, forming a single compartment for the storage of the liquid. The shape of the container and the types of liquids stored therein vary widely, however, a common characteristic is that the container consists of a single storage compartment and therefore is limited to the storage of only one type of liquid at a time.

There are, however, cases in which it would be advantageous to store two or more kinds of liquids simultaneously in one container. This is particularly so when dealing with liquids of different types or those which comprise incompatible chemical substances that should not be mixed during storage. While such liquids may be intended for mixing, this does not occur prior to actual usage.

Existing storage containers could not, for example, be utilized for the separate storage of two or more ingredients required for the preparation of a cocktail drink, such as gin and tonic or tomato juice and vodka. Similarly, there are medical prescriptions which consist of two or more liquids which require mixing prior to usage. In both cases, separate storage is required and this generally involves producing two or more containers, each storing one type of liquid.

Thus, it would be desirable to provide a multi-compartment container allowing for simultaneous storage of different liquids which are intended for mixing upon pouring.

SUMMARY OF THE INVENTION

Accordingly, it is a principal object of the invention to overcome the limitations of the existing single compartment liquid storage container and provide a multi-compartment container capable of simultaneously storing two or more liquids intended for mixing upon pouring.

In accordance with a preferred embodiment of the present invention, there is provided a multi-compartment liquid storage container comprising a container having a plurality of storage compartments each capable of separately storing a different liquid, said different liquids becoming mixed when poured during removal from said container.

In a preferred embodiment of the invention, the inventive storage container comprises a primary container with an internal container of smaller diameter set in the cylindrical hollow of the primary container, thus creating an additional storage compartment. The primary storage container is provided with a removable pull tab. Removal of the pull-tab enables access to the contents of the primary container and the additional storage compartment.

The internal container is fixedly attached to the bottom of the primary container and is sealed at the top in part by the primary container and in part by the pull-tab attached thereto. Opening of the primary container by removal of the pull-tab allows for immediate access to the liquids contained in both primary and internal containers.

In an alternative embodiment, the primary container is provided with a non-removable lift-tab opening. In this arrangement, a penetrable foil section is provided in the wall of the internal container. The lift-tab perforates the foil during the opening procedure to provide internal container access.

In another alternative embodiment of the invention, the internal container is sub-divided by additional compartments each sealed off from the other by a penetrable foil membrane, thus allowing for separate storage of a plurality of liquids simultaneously. This alternative embodiment of the invention may be provided in combination with either a removable pull-tab or non-removable lift-tab opening. A straw may be used to perforate the membrane between the sections, allowing access to the liquids.

In still another alternative embodiment, the inventive container has a plurality of access openings, each opening allowing access to a separate storage compartment. When the access openings are opened together, the liquids may be simultaneously poured and mixed.

Various container constructions using different materials are possible, including metal containers (coated tin, aluminum, etc), glass bottles, paper or cardboard containers, or combinations of these materials.

In addition to container constructions using a pull-tab for sealing, various closures are possible, including the vacuum-sealed twist-cover type, and the aluminum foil cover which can be peeled off and removed.

The inventive container design enables separate liquid storage in many applications, including premeasured cocktail mixes and medicinal preparations.

Additional features of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout and in which.

DETAILED DESCRIPTION OF THE PREFERRED EMBODIMENTS

Figure 1:
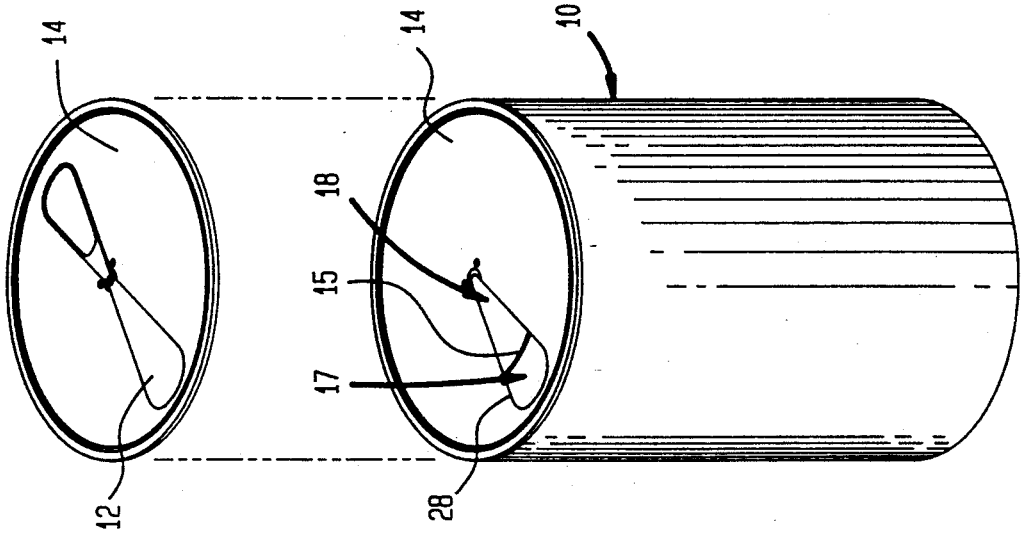
FIG. 1 is a perspective view of a preferred embodiment of a multi-compartment liquid storage container constructed in accordance with the principles of the invention.

Referring to FIG. 1, there is shown an illustration of a multi-compartment liquid storage container 10 having an opening arrangement comprising a pull-tab 12 disposed in the top wall 14. Removal of pull-tab 12 reveals the outer wall 15 of an internal storage container 16 which defines a primary storage compartment 17 and an internal storage compartment 18. Container 10 is of a well-known standard construction and is generally made of aluminum or thin sheet metal. Container 10 is commonly used by manufacturers of a wide variety of liquid beverage drinks.

It will be appreciated that various container constructions using different materials are possible, including glass, paper or cardboard, or combinations of these materials.

Figure 2B:
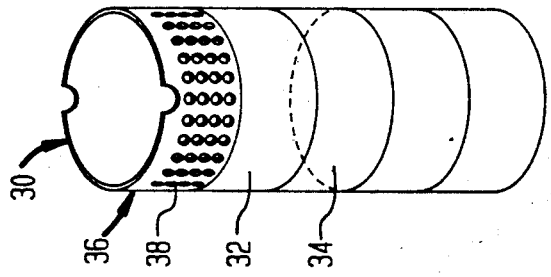
FIG. 2*b* is a perspective view of the subdivided internal storge container, as an alternative for use in FIG. 2*a;*
Figure 2A:
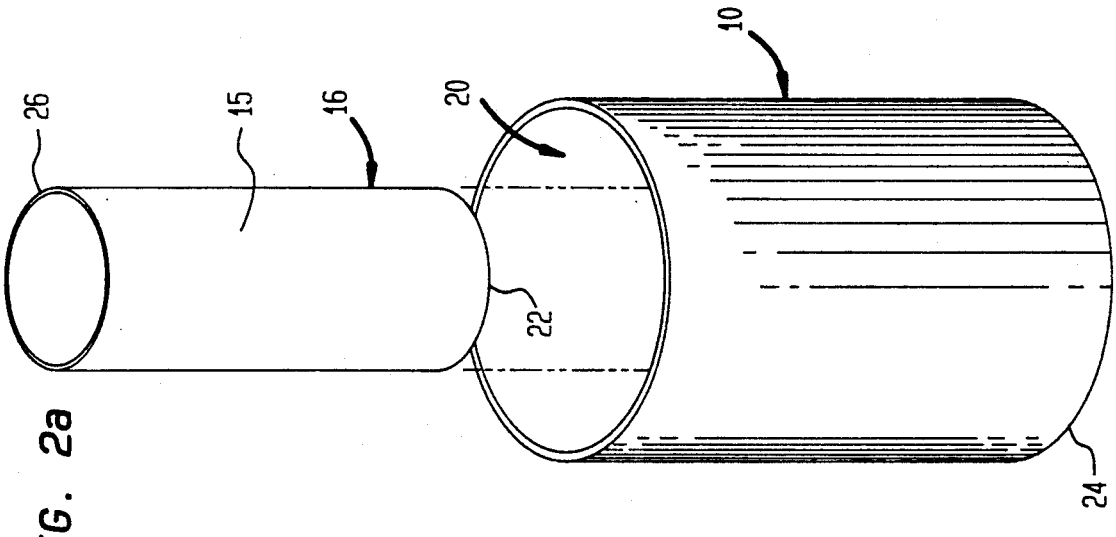
FIG. 2*a* is an exploded perspective view of the container of FIG. 1 showing an internal storage container.

FIG. 2*a* shows an illustration of an exploded perspective view where internal storage container 16 is a cylindrically-shaped container of smaller diameter than the primary container 10 and is set in the cylindrical hollow 20 of the primary container 10. The internal container 16 is fixedly attached at its bottom section 22 to the primary container 10 bottom wall 24 and sealed at its top rim 26 in part by the top wall 14 of primary container 10 and in part by the underside of pull-tab 12. Alternatively, the bottom section 22 of internal container 16 is not fixedly attached to bottom wall 24.

In the normally closed position, pull-tab 12 seals aperture 28. Upon removal of pull-tab 12, the liquids stored in both primary storage container 10 and internal storage container 16 are accessible. Thus, once pull-tab 12 has been removed, the liquid contents stored in primary container 10 and internal storage container 16 may be immediately poured and mixed.

FIG. 2*b* shows a subdivided internal storage container 30 which may be provided as an alternative to internal storage container 16. Container 30 is provided with additional subdivided compartments 32 each sealed from the other by a penetrable foil membrane 34. The alternative embodiment of FIG. 2*b* enables simultaneous storage of a plurality of liquids. These liquids may be accessed upon removal of tab 12 via aperture 28 by tearing penetrable foil membranes 34, thus allowing removal of the liquid contents stored in each of subdivided compartments 32.

FIG. 2*b* also illustrates an additional feature of the alternative embodiment, whereby the top section 36 of the container 30 is provided with perforations 38. This section of container 30 does not store liquid. The perforations 38 in top section 36 are designed to facilitate the pouring procedure in the preferred embodiment of FIG. 1 by facilitating the passage of air during the pouring procedure, causing turbulence and mixing.

Figure 3A:
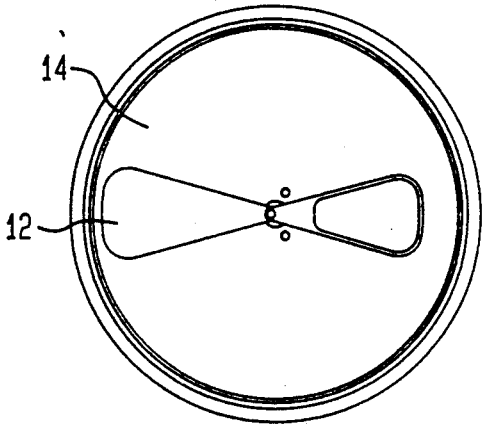
FIG. 3*a* is a top view of the container of FIG. 1 showing a removable pull-tab construction.

FIG. 3*a* is a top view of primary container 10 shown in FIG. 1 incorporating a removable pull-tab 12 construction. It will be appreciated that in addition to the pull-tab construction, various other closures are possible, including the vacuum sealed twist-cover type, and aluminum foil cover which can be peeled off and removed.

Figure 3B:
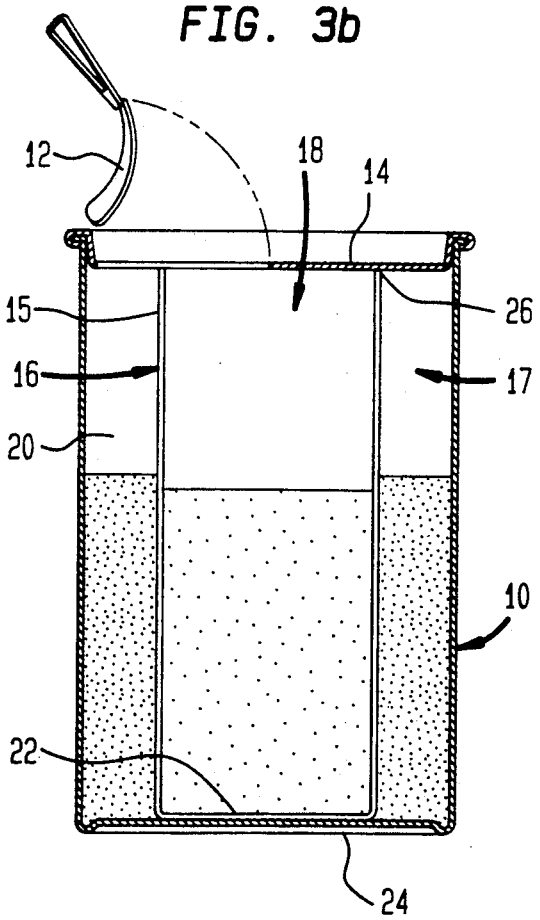
FIGS. 3*b*–3*c* are respectively, cross-sectional side views of the container of FIGS. 1–2*a,b* showing a single and subdivided internal storage container.

FIG. 3*b* is a cross-sectional side view of the preferred embodiment described in FIG. 2*a* illustrating simultaneous liquid storage in both primary container 10 and in internal storage container 16. Internal storage container 16 is fixedly attached at its bottom section 22 to primary container bottom wall 24 as shown in FIG. 2*a*, and is positioned in cylindrical hollow 20 of primary container 10 such that upon removal of pull-tab 12, simultaneous access is provided to the liquid contents of primary and internal storage containers 10, 16.

Figure 3C:
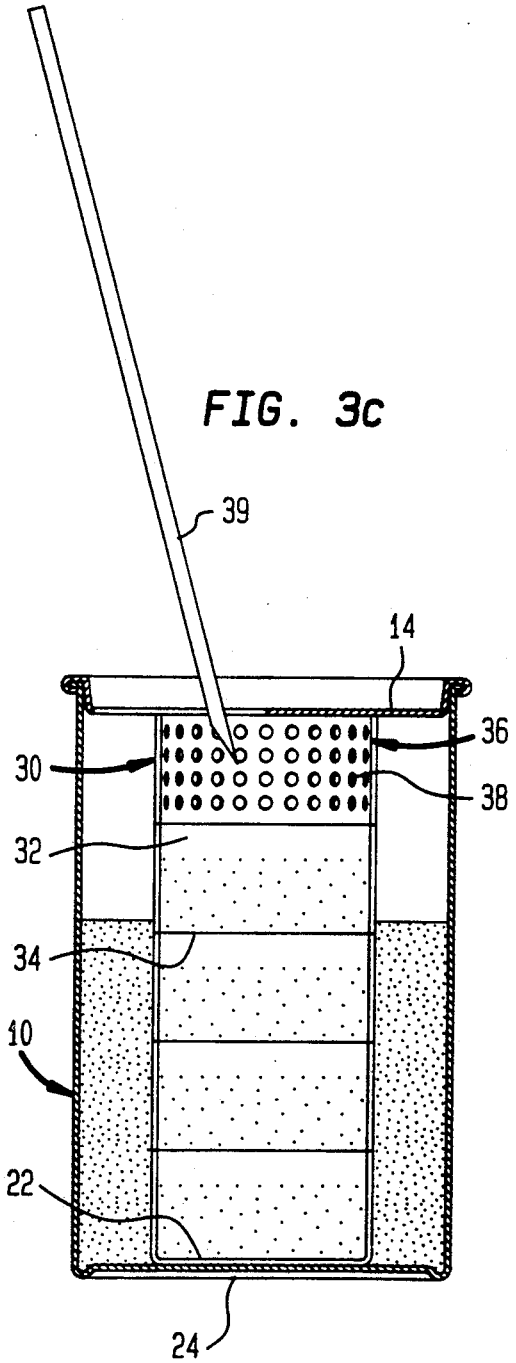

FIG. 3*c* illustrates a cross-sectional side view of subdivided internal storage container 30 where each compartment 32 thereof contains and stores a separate liquid. Subdivided compartments 32 are sealed from each other by a penetrable foil membrane 34 as described with respect to the FIG. 2*b* embodiment. A straw 39 may be used to tear the membranes 34 to allow the contents of compartments 32 to be immediately poured and mixed.

Figure 4A:
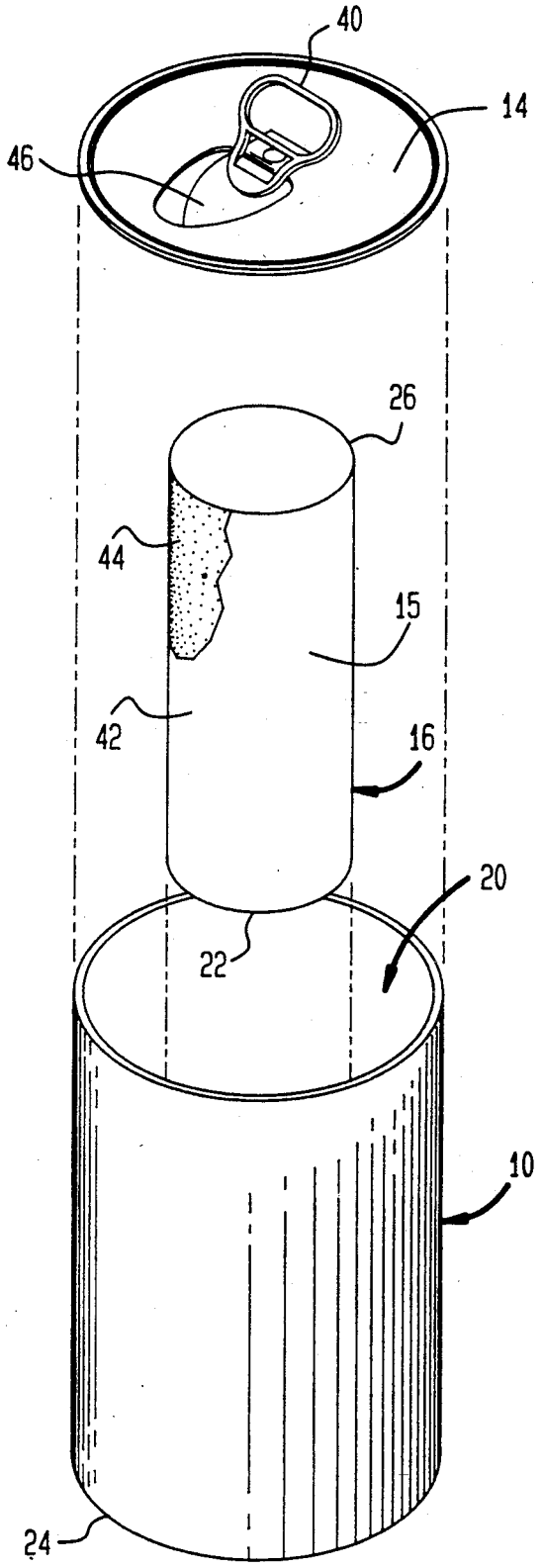
FIG. 4*a* is an exploded perspective view of an alternative embodiment of the container of FIG. 1, featuring a non-removable lift-tab.

FIG. 4*a* is an exploded perspective view of an alternative embodiment of the primary container 10 of FIG. 1 featuring a non-removable lift-tab 40. Upper side wall portion 42 of internal storage container 16 features a penetrable foil membrane 44 which may be penetrated during the lift-tab opening procedure, enabling simultaneous access to the liquid contents of primary container 10 and internal storage container 16.

Figure 4B:
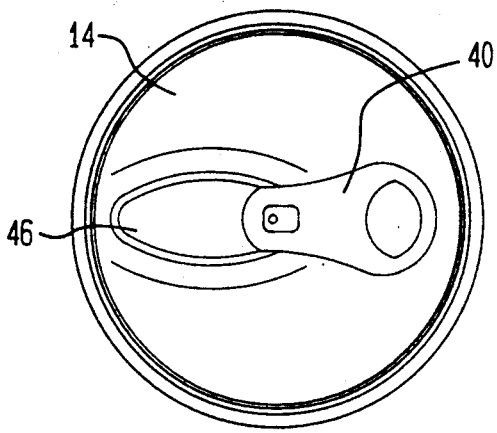
FIG. 4*b* is a top view of the container of FIG. 4*a;*
Figure 4C:
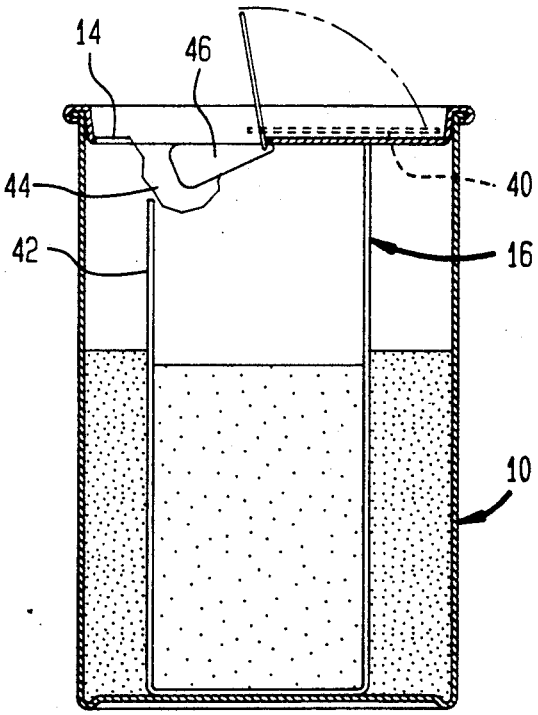
FIG. 4*c* is a cross-sectional side view of the container of FIG. 4*a* showing a single internal storage container.

In FIG. 4*b*, a top view of primary storage container 10 is shown with the non-removable lift-tab arrangement, and in FIG. 4*c*, a cross-sectional side view is shown, revealing internal storage container 16 and the foil membrane 44 in upper side wall portion 42. During the lift-tab 40 opening procedure, the tip 46 of lift-tab 40 presses against foil membrane 44, tearing it, and allowing access to the liquid contents of internal storage container 16.

Figure 4D:
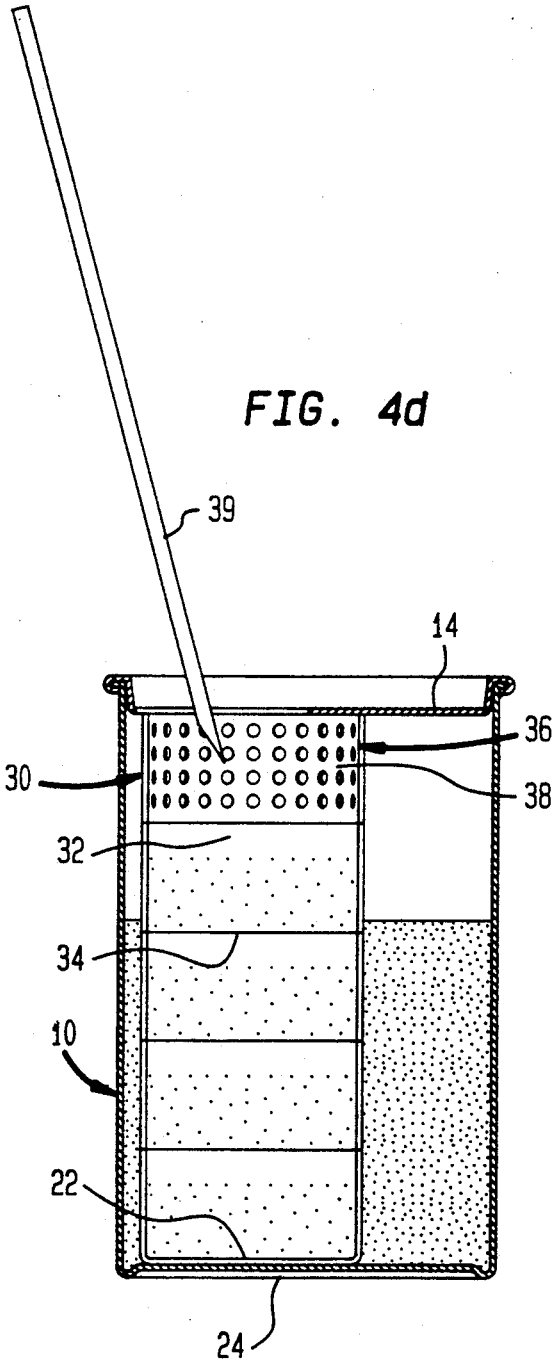
FIG. 4*d* is a cross-sectional side view of the container of FIG. 4*a* showing a subdivided internal storage container.

FIg. 4*d* illustrates a cross-sectional side view of primary container 10 in an alternative embodiment providing the subdivided internal storage container 30 shown in FIG. 2*b* in combination with the non-removable lift-tab 40 shown in FIG. 4*c*.

In the cross-sectional side view of FIG. 4*d*, subdivided internal storage container 30 is shown offset from the center of primary storage container 10. This is to allow the tip 46 of lift-tab 40 to clear the top section 36 and perforations 38. Straw 39 is then used to penetrate the membranes 34, allowing the contents of compartments 32 to be poured out.

Figure 5:
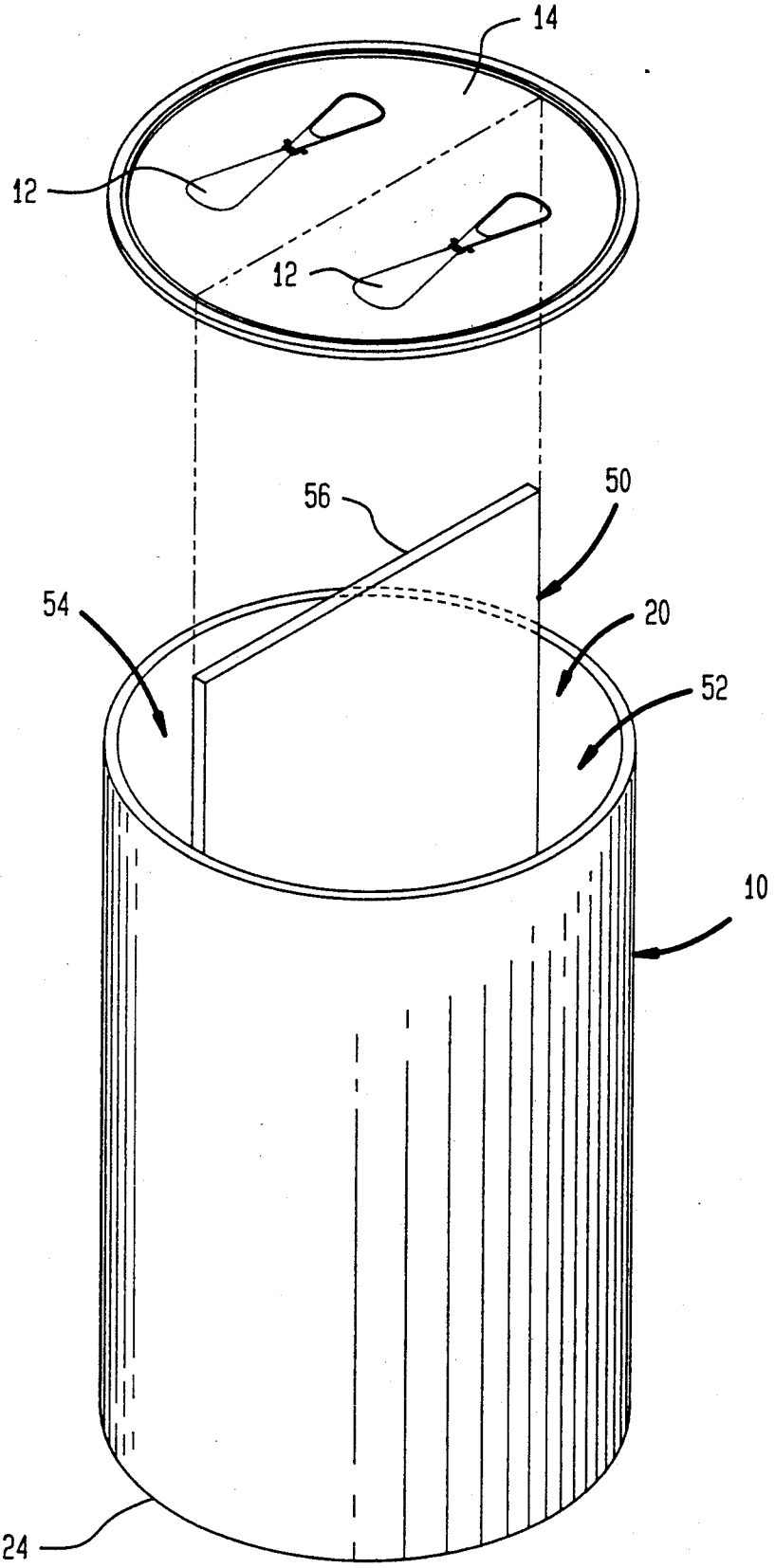
FIG. 5 is an exploded perspective view of another alternative embodiment, showing a partition and two container access openings for pouring the contents of multiple compartments.

In FIG. 5, there is shown an exploded view of another alternative embodiment of container 10, with an interior partition 50 dividing the cylindrical hollow 20 into a plurality of compartments 52 and 54, each of which may store a separate liquid. Top wall 14 is provided with a plurality of pull-tabs 12, each providing access to a respective one of compartments 52, 54.

Interior partition 50 may be sealed on the upper edge 56 thereof to the underside of top wall 14 by use of an appropriate sealing material. Thus, when pull-tabs 12 are removed, the contents of compartments 52, 54 may be poured and mixed simultaneously. Interior partition 50 may be modified as needed to provide more than two internal compartments.

In accordance with the principles of the invention, primary storage container 10 and internal storage containers 16, 30 or compartments 52, 54 allow for separate storage of a plurality of liquids, which can be immediately mixed upon opening container 10, using either the closing arrangement of pull-tab 12 or that of lift-tab 40. This provides many advantages and can be applied to mixtures for beverages, such as cocktail mixes, or for medicinal preparations, for example.

It will be appreciated that methods of filling container 10 with liquids in the storage compartments may vary, and will be adapted as needed in accordance with the particular container 10 design.

While the principles of the invention have been described with regard to particular embodiments, it is to be understood that the description is made by way of example only and not as a limitation on the scope of the invention which is set forth in the appended claims.

We claim:

1. A multi-compartment liquid storage container comprising a container having a plurality of storage compartments each capable of separately storing a different liquid, said different liquids becoming mixed when poured during removal from said container, wherein at least two of said plurality of storage compartments are defined by a cylindrical internal container wall within said container, forming concentric first and second internal storage compartments, and wherein a single access opening of said container is arranged to provide access to both said first and second internal storage compartments, said access opening comprising:

an aperture formed in a substantially flat cover over said container such that said aperture communicates with said first and second internal storage compartments; and a tab sealing said aperture and being at least partially removable therefrom, said tab sealing against an upper edge of said internal container wall between said first and second internal storage compartments.

2. The container of claim 1 wherein said sealing tab comprises a pull-tab sealing said aperture which is in communication with said plurality of storage compartments, said pull tab also sealing said internal container wall between said first and second internal storage compartments.

3. The container of claim 1 wherein said sealing tab comprises a non-removable lift-tab sealing said aperture, said lift-tab perforating a foil membrane between said first and second storage compartments during an opening procedure.

4. A multi-compartment liquid storage container comprising a container having a plurality of storage compartments each capable of separately storing a different liquid, said plurality of storage compartments sharing a normally sealed access opening, said different liquids becoming mixed when poured during removal from said container via said shared access opening when opened, wherein said plurality of storage compartments are defined by a plurality of concentric cylindrical internal container walls within said container, and wherein said access opening comprises:

an aperture formed in a substantially flat cover over said container such that said aperture communicates with said plurality of internal storage compartments; and a tab sealing said aperture and being at least partially removable therefrom, said tab sealing against upper edges of each of said internal container walls between said plurality of internal storage compartments.

5. A method of separately storing a plurality of liquids simultaneously in a storage container for mixing during removal, said method comprising the steps of:

providing a storage container having a plurality of separate storage compartments sharing a normally sealed common access opening, wherein said plurality of storage compartments are defined by a plurality of concentric cylindrical internal container walls within said container, and wherein said access opening comprises:

an aperture formed in a substantially flat cover over said container such that said aperture communicates with said plurality of internal storage compartments; and a tab sealing said aperture and being at least partially removable therefrom, said tab sealing against upper edges of each of said internal container walls between said plurality of internal storage compartments;

providing access via said tab to said plurality of separate compartments through said common access opening; and pouring said plurality of liquids through said common access opening such that they become mixed.

6. The method of claim 5 wherein at least one of said plurality of separate compartments has subdivided compartments and said step of providing access to said plurality of separate compartments includes the step of providing access to said subdivided compartments.

* * * * *